United States Patent [19]

Gliha, Jr.

[11] 4,264,116

[45] Apr. 28, 1981

[54] FILTER CONNECTOR WITH ADAPTOR FOR QUICK DISCONNECTION

[75] Inventor: Edward R. Gliha, Jr., Bainbridge, N.Y.

[73] Assignee: The Bendix Corporation, Southfield, Mich.

[21] Appl. No.: 71,627

[22] Filed: Aug. 31, 1979

[51] Int. Cl.[3] ..... H01R 13/64

[52] U.S. Cl. ..... 339/89 M; 339/90 R; 339/147 R; 339/186 M

[58] Field of Search ..... 339/147, 89, 90, 184 M, 339/186, 205 C

[56] References Cited

U.S. PATENT DOCUMENTS

| | | | |
|---|---|---|---|
| 3,587,032 | 6/1971 | Normann | 339/89 M |
| 3,960,428 | 6/1976 | Naus et al. | 339/90 R |
| 3,961,294 | 6/1976 | Hollyday | 339/147 R |
| 4,023,881 | 5/1977 | Migneau | 339/89 R |
| 4,082,398 | 4/1978 | Bourdon | 339/59 M |
| 4,195,272 | 3/1980 | Boutros | 339/147 R |

FOREIGN PATENT DOCUMENTS

| | | | |
|---|---|---|---|
| 2279236 | 2/1976 | France | 339/147 R |

*Primary Examiner*—John McQuade
*Attorney, Agent, or Firm*—Paul J. Ethington; C. Dennis Lacina; Raymond J. Eifler

[57] ABSTRACT

A filter connector is disclosed with an adaptor member (14) which permits removal and replacement of the filter connector member (10) without individually disconnecting and reconnecting the wires (16). The filter connector member (10) is provided with a plurality of filter contacts (22) each having a mating end (pin 26) at the forward end and a mating end (pin 28) at the rear end. A filterless connector member (12) includes plural filterless contacts each having a wire receiving end (74) and a mating end (socket 72) adapted to mate with the pin (26) of the corresponding filter contact (22). An adaptor member (14) includes a plurality of filterless contacts (42) each having a wire receiving end (90) and having a mating end (socket 88) adapted to mate with the pin (28). The filterless contacts (42) in the adaptor (14) are individually removable and replaceable in the event of a malfunction in these contacts. The filter connector member is detachably mateable with the filterless contact member (12) and with the adaptor member (14) whereby it may be removed and replaced in the event of a malfunction in a filter contact.

7 Claims, 5 Drawing Figures

FILTER CONNECTOR WITH ADAPTOR FOR QUICK DISCONNECTION

TECHNICAL FIELD

This invention relates to electrical connectors of the type including a plug and a receptacle member each having multiple electrical contacts; more particularly, it relates to filter connectors in which one of the connector members is provided with contacts each incorporating an electrical filter.

BACKGROUND OF THE INVENTION

Electrical filter connectors are well known and are used in electronic systems susceptible to unwanted signals such as radio frequency interference or other noise. Typically, filter connectors comprise a pair of separable connector members having multiple pairs of mating contacts. One of the connector members, a filter connector member, is provided with filter contacts each of which has a mating end and a wire receiving end. The filter contacts are of fragile construction and are mounted within the connector shell so as to be isolated from external forces that may be applied to the ends of the contacts. Typically, the filter elements are encapsulated so that they are not removable from the connector shell. The other connector member, a filterless connector member, is provided with contacts which have no filter element incorporated therein, i.e. filterless contacts. Typically, the filterless contacts are removably mounted within the connector shell. Such a filter connector is disclosed in U.S. Pat. No. 4,029,386 to Krantz et al. Other filter connectors of this general type are disclosed in U.S. Pat. No. 3,710,285 to Schor, et al.; U.S. Pat. No. 3,569,915 to Sorensen et al.; and U.S. Pat. No. 3,721,869 to Paoli.

Since the filter connector member is provided with filter contacts which are not removable from the connector shell, a malfunction in one of the filter contacts requires removal and replacement of the filter connector member. This entails connecting each contact of the replacement connector member to each of the corresponding wires. Further, if a malfunction occurs in the wire receiving end of one or more contacts the entire filter connector member must be removed and replaced. The filter connector member is costly and the replacement operation which requires individual reconnection of multiple contacts with corresponding wires is a time consuming operation.

A general object of this invention is to obviate certain of the disadvantages in prior art filter connectors.

DISCLOSURE OF THE INVENTION

In accordance with this invention, a filter connector is provided in which the filter connector member may be removed and replaced without individually disconnecting and reconnecting all of the contacts and corresponding wires. This is provided by a filter connector member in which each filter contact has mating ends on both front and rear so that it can mate with a corresponding contact in the filterless connector member and also with a corresponding contact in an adaptor member.

Further, according to this invention, a filter connector is provided in which a damaged or defective connection with a filter contact may be repaired without replacement of the filter contact itself. This is accomplished by the aforesaid filter connector member in combination with an adaptor member having individually removable and replaceable contacts each of which has a mating end and wire receiving end.

The invention comprises a filter connector with a first or filter connector member having a plurality of filter contacts each having first and second mating ends. A second or filterless connector member includes a plurality of filterless contacts each having a wire receiving end and having a mating end adapted to mate with one end of the corresponding filter contact. An adaptor member includes a plurality of filterless contacts each having a wire receiving end and having a mating end adapted to mate with the other end of the corresponding filter contact. The filterless contacts in the adaptor member are individually removable and replaceable. The filter connector member is detachably mateable with the filterless contact member and with the adaptor member whereby it may be removed and replaced in the event of a malfunction in a filter contact. Each filterless contact in the adaptor member and each filterless contact in the filterless connector member is individually removable and replaceable so that a defective connection to a filter contact can be repaired individually without replacing the filter connector member.

In a preferred embodiment, the adaptor member comprises an adaptor ring and a dielectric insert member in the ring for removably supporting the filterless contacts. A coupling nut is rotatably mounted on the ring and is adapted to threadedly engage the filter connector member with keying means coacting between the ring and the filter connector member. The keying means comprises means for orienting the dielectric insert member within said coupling nut and means for orienting said coupling nut relative to said filter connector member so as to align the corresponding contacts of the adaptor member and the filter connector. The means for orienting the insert member with the coupling nut includes a detent and the means for aligning the coupling nut with the filter connector member includes a spring finger on the coupling nut and a keyway on the filter connector member whereby corresponding mateable contacts may be aligned and pushed into partial mating engagement so that rotation of the coupling nut will draw them into full mating engagement.

A more complete understanding of the invention may be obtained from the detailed description that follows taken with the accompanying drawings.

BEST MODE FOR CARRYING OUT THE INVENTION

Figure 1:
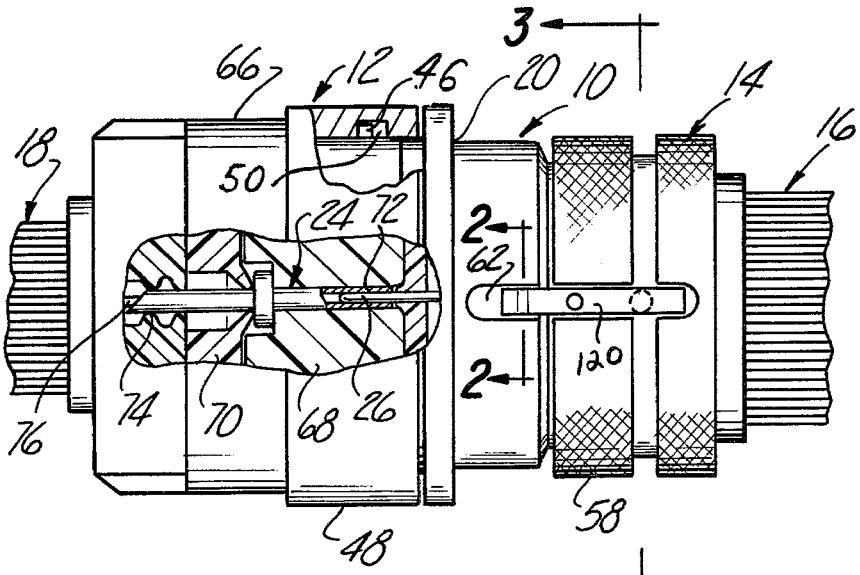
FIG. 1 is an assembly view with parts broken away, of the filter connector of this invention.
Figure 2:
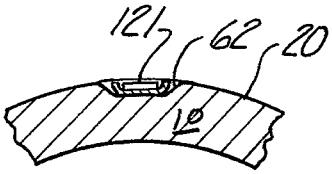
FIG. 2 is a view taken on lines 2—2 of FIG. 1.

Referring now to the drawings, there is shown an illustrative embodiment of the invention in a filter connector of the plug and receptacle type having multiple pairs of corresponding contacts. It will be appreciated, as the description proceeds, that the invention is useful in many different types of filter connectors.

Figure 4:
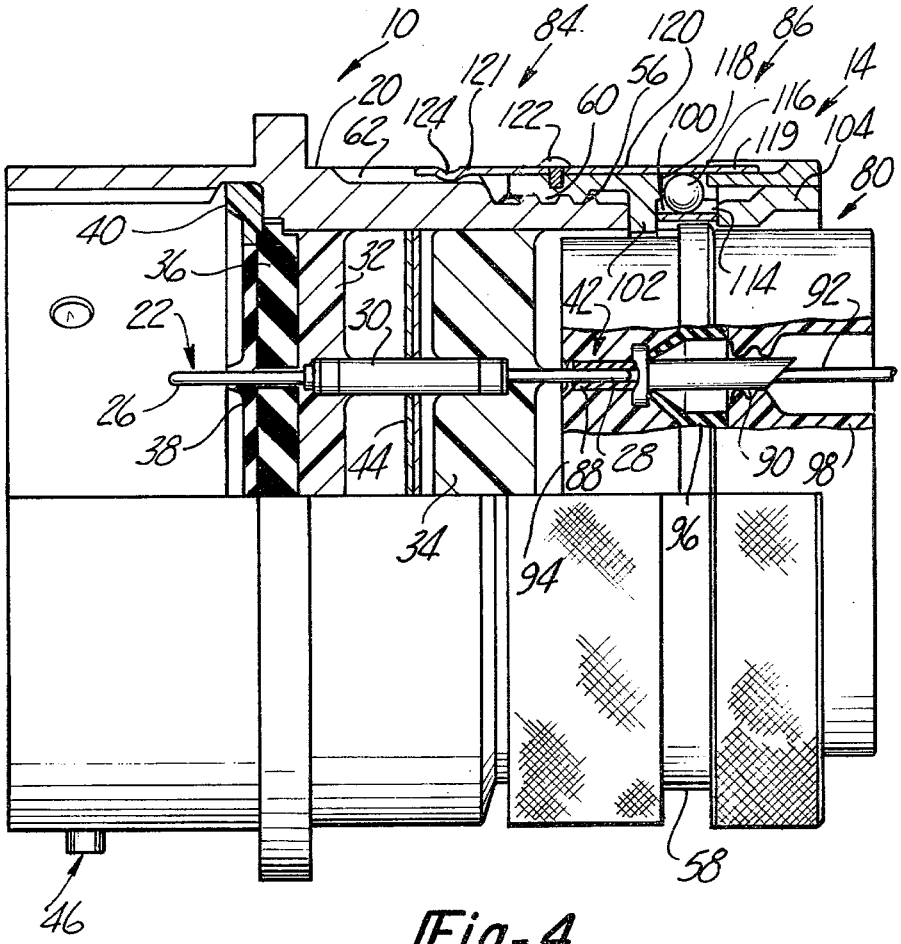
FIG. 4 shows the filter connector member and the adaptor member in full mating engagement, partially in section.

The filter connector is shown in its assembled relation in FIG. 1. In general, it comprises a filter connector member 10, a filterless connector member 12 and an adaptor member 14. The adaptor member 14 receives multiple conductors or wires 16 each of which is connected through the filter connector member 10 to a corresponding one of multiple conductors or wires 18 received by the filterless connector 12. The filter connector member 10, as best shown in FIG. 1 and 4, comprises a cylindrical metal shell 20 which contains a plurality of filter contacts 22, only one of which is shown in the drawings. The filter connector member 10 is a receptacle type member which mates with the filterless connector member 12 which is a plug type member to provide electrical interconnection between the corresponding mating contacts. Each of the filter contacts 22 has a front mating end which is a pin 26 adapted to mate with a corresponding mating contact which is a socket 24 in the member 12. Each of the filter contacts 22 also has a rear mating end which is a pin 28. Each filter contact 22 also comprises a filter element 30 disposed intermediate the mating ends or pins 26 and 28 and which is supported and encapsulated in a manner which will be described subsequently.

The filter contacts 22 are mounted within the shell 20 as follows. The forward end of each filter contact is supported in a front wall or plate 32, suitably of epoxy resin, which encapsulates the front end of the filter element 30. The rear end of each filter contact is supported in a rear wall or plate 34, suitably of epoxy resin, which encapsulates the rear end of the filter element 30. The pin 26 extends through the plate 32 and a dielectric insert member 36 of plastic and through an interfacial seal 38 of soft elastomeric material. A gasket 40 is disposed around the seal 38. The pin 28 extends through the plate 34 and is adapted to be received in mating relation with a mating contact which is a socket 42 in the adaptor member 14, which will be described subsequently. The filter element 30 of the contact 22 is provided with a grounding plate 44, suitably a soldered metal foil, for connecting the external surface of the filter element 30 to the shell 20. It is noted that the plates 32 and 34 support each contact 22 and encapsulate the filter element 30 and isolate it from forces applied to the ends of the contact.

The filter connector member 10 is adapted to be separably connected with the filterless member 12; for this purpose, the members are provided with coacting screw thread means which, in the illustrative embodiment, takes the form of a bayonet coupling. The forward end of the shell 20 is provided with a set of bayonet pins 46 and the connector member 12 is provided with a coupling nut 48 having internal ramp grooves 50 which threadedly engage the pins 46. The filter connector member 10 is also adapted to be separably connected with the adaptor member 14; for this purpose, the members are provided with screw thread means which, in the illustrative embodiment, take the form of a triple-start screw thread. The filter connector member 10 has an external screw thread 56 on its rear end. The adaptor member 14 includes a coupling nut 58 which has an internal screw thread 60 which coacts with the thread 56. It is noted that the shell 20 of the filter connector member 10 is provided with a longitudinally extending groove or keyway 62 for orienting purposes which will be described in greater detail subsequently.

The filterless connector member 12 is of known construction. It comprises a cylindrical metal shell 66 which contains multiple socket type contacts 24. The socket contacts are removably supported within the shell 66 in a dielectric insert member 68 and a retention member 70. The retention member 70 is of a well known type, such as disclosed in U.S. Pat. No. 4,082,398 to Bourdon, et al., which facilitates insertion and removal of contacts for ease of assembly and service. Each of the socket contacts 24 has a mating end which is a socket 72 and a wire receiving end 74. The wire receiving end is adapted to receive a conductor or wire 76 which is crimped in the wire receiving end 74. The dielectric insert member 68 is non-rotatably mounted in the shell 66 by keying means (not shown) which orients the member relative to the shell. The shell 66 and the shell 20 of the filter connector member are provided with coacting keying means (not shown) to orient the pins 26 relative to the sockets 74. When the filterless connector member 12 is properly oriented relative to the filter connector member 10, rotation of the coupling nut 48 draws the members together so that each pin 26 is fully mated with its corresponding socket 72.

The adaptor member 14 comprises, in general, the aforementioned coupling nut 58 which supports an insert assembly 80 which in turn contains multiple filterless contacts 42. Further, the coupling nut 58 is provided with aligning or keying means 84 and locking means 86 which will be described in detail subsequently.

The multiple filterless contacts 42 are supported in the insert assembly 80. Each contact comprises a mating end which is a socket 88 and a wire receiving end 90. The socket 88 is adapted to receive the pin 28 of the filter contact 22. The wire receiving end 90 receives a wire 92 which is crimped thereto. The insert assembly 80 includes an dielectric insert member 94, a contact retention member 96 and a grommet 98 all of which have aligned passages for receiving each of the contacts 42. The mating end of the contact 42 is seated in the insert member 94 and is removably held in place by the spring fingers of the retention member 96. The retention member 96 is of the same type as retention member 70, described above, to facilitate insertion and removal of contacts.

Figure 3:
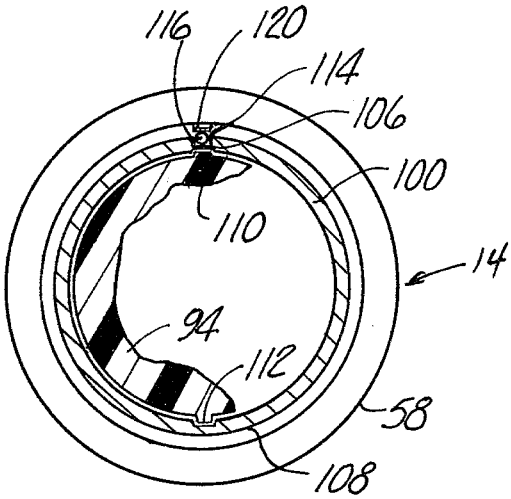
FIG. 3 is a view taken on lines 3—3 of FIG. 1.

For the purpose of supporting the insert assembly 80 in the coupling nut 58, an adaptor ring 100 is rotatably mounted within the coupling nut 58. The adaptor ring 100 is seated against an internal annular flange 102 on the coupling nut 58 and is held in place by a retainer ring 104 which has a press fit with the rear of the coupling nut 58. It is noted that the adaptor ring 100 has a clearance fit inside the coupling nut and is freely rotatable therein. As shown in FIG. 3, the insert member 94 and the adaptor ring 100 are provided with keying means to orient them relative to each other. The keying means comprises a major keyway 106 and a diametrically opposite minor keyway 108 on the internal surface of the adaptor ring. The insert member 94 is provided with a major key 110 and a minor key 112 which are disposed in the respective keyways 106 and 108. Thus, the adaptor ring 100 is keyed to the insert member 94 and they are rotatably mounted inside the coupling nut 58. The locking means 86 is provided in order to orient the adaptor ring 100 and the insert member 94 relative to the coupling nut 58. Locking means 86 comprises a first detent element in the form of an axially extending slot 114 in the outer surface of the adaptor ring 100 and also includes a second detent element in the form of a steel ball 116 which is held captive in a cylindrical passage 118 extending radially through the coupling nut 58. The ball 116 is biased radially inwardly of the passage by the rear end 119 of a leaf spring 120 which extends axially of the coupling nut 58 and is secured thereto by a fastener 122. The leaf spring 120 resiliently urges the ball 116 radially inwardly and, with the insert assembly 80 in a reference position relative to the coupling nut 58, the ball 116 is seated in the groove 114. The spring 120 exerts sufficient force on the ball 116 that the insert assembly 80 and the coupling nut 58 are locked in this relative position; however, the locking action may be overcome by manual rotation of the coupling nut 58 relative to the insert assembly 80 which causes camming action on the ball 116 which is displaced from the groove 114 and rides on the peripheral surface of the adaptor ring 100 during the relative rotation.

Figure 5:
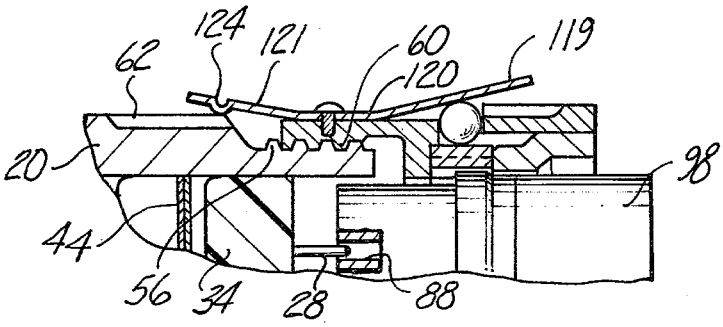
FIG. 5 is a fragmentary view showing the filter connector member and adaptor member in partial mating engagement.

The aligning or keying means 84 for the coupling nut 58 includes the groove 62 on shell 20 and a key in the form of a spring finger comprising the front end of the leaf spring 120. The front end 121 of the leaf spring 120 includes a protuberance 124 which is adapted to be seated in the groove 62. The angular location of the groove 62 on the shell 20 is correlated with the reference position of the coupling nut 58 on the adaptor ring 100 so that alignment of the leaf spring 120 with the groove 62 is effective to align the pin 28 of each filter contact 22 with the socket 88 of each filterless contact 42. As shown in FIG. 5, the length of the leaf spring 120 is such that the protuberance 124 thereof will reach and be seated in the end of the groove 62 before the pin 28 of each filter contact 22 enters the socket 88 of each filterless contact 42. Further, the thread 56 on the filter connector member 10 and the coacting thread 60 on the coupling nut 58 are located so that the threads are angularly positioned for starting engagement when the coupling nut 58 is in its reference position relative to the adaptor ring 100 with the leaf spring 120 aligned with the groove 62. The threads are axially positioned for starting engagement when the coupling nut 58 is axially positioned so that the pin 28 of each filter contact 22 is partially mated, i.e. slightly inserted into, the socket 88 of the contact 42. In this condition, the coupling nut 58 may be rotated relative to the adaptor ring 100, and hence the insert assembly 80, which will be held fast by the mating engagement of the pins 28 and sockets 88. This relative rotation will cause the ball 116 to move radially outwardly of the groove 114 against the rear end of the spring 120, as shown in FIG. 5. Similarly, the relative rotation will cause the forward end of the spring 120 to be cammed outwardly of the groove 62, as shown in FIG. 5. After one complete revolution of the coupling nut 58, the ball 116 will reach the groove 114 and will be seated therein by the bias force of the spring 120. At the same time the forward end of the spring 120 will be seated in the groove 62 and the filter contacts 22 and the filterless contacts 42 will be fully mated, as shown in FIG. 4.

The filter connector of this invention allows the filter connector member 10 to be quickly detached in the event of a malfunction of one of the filter contacts. This is done by disconnecting the filterless connector 12 by unscrewing the coupling nut 48 and disconnecting the adaptor member 14 by unscrewing the coupling nut 58. The filter connector member 10 may be replaced as a unit by a new filter connector member which is connected between the filterless connector member 12 and the adaptor member 14 by operation of the respective coupling nuts. In the event of malfunction of one or more of the filterless contacts 42 in the adaptor member 14, the malfunctioning contacts may be individually removed and replaced. Similarly, if one or more of the filterless contacts 24 in the connector member 12 malfunctions, it may be individually removed and replaced.

Although the description of this invention has been given with reference to a particular embodiment, it is not to be construed in a limiting sense. Many variations and modifications of the invention will now occur to those skilled in the art. For a definition of the invention reference is made to the appended claims.

What is claimed is:

1. A filter connector comprising:

a first connector member comprising:

a cylindrical shell;

a plurality of filter contacts;

means in said cylindrical shell supporting said filter contacts, each of said filter contacts having first and second mating ends and thread means on said cylindrical shell;

a second connector member including a plurality of filterless contacts, each of said filterless contacts having a wire receiving end and having a mating end adapted to mate with the first mating end of a corresponding one of the filter contacts;

an adaptor member including a plurality of filterless contacts, said adaptor member comprising an adaptor ring and a dielectric insert in said adaptor ring for supporting said filterless contacts, each of said filterless contacts having a wire receiving end and having a mating end adapted to mate with the second mating end of a corresponding one of said filter contacts, each of said filterless contacts in said adaptor member being individually removable and replaceable;

means for removably connecting said first connector member to the second connector member with the filter contacts mated with the filterless contacts;

a coupling nut rotatably mounted on said adaptor ring and adapted to threadedly engage said first connector member whereby the filterless contacts are mated with the corresponding filter contacts;

means for orienting said adaptor member relative to said first connector member, said means for orienting comprises key means coacting between said adpator ring and said first contact member, said keying means including a key mounted externally on said coupling nut and a keyway in the external surface of said cylindrical shell, said key being radially deflectable from said keyway when the coupling nut is rotated to draw the mating contacts on the first connector member and the adaptor member into mating engagement whereby the first connector member may be removed and replaced in the event any one of the filter contacts is defective.

2. The invention as defined in claim 1 including locking means for locking said coupling nut to said insert.

3. The invention as defined in claim 1 wherein said locking means comprises a recess in the external surface of said ring and a spring-biased element on said coupling nut and adapted to be seated in said recess.

4. In a filter connector member of the type including a connector shell, a first plurality of filter contacts, means for supporting the filter contacts in the shell and thread means on said shell, each of said filter contacts having one end thereof adapted to mate with a corresponding contact disposed in another mateable connector member, the improvement comprising each of said filter contacts has a second mating end;

an adaptor member including an adaptor ring, plural filterless contacts, and a dielectric insert in said ring for supporting said filterless contacts, each of said filterless contacts having a mating end and a wire receiving end, each of said filterless contacts being individually removable and replaceable;

means for orienting said adaptor member so that the mating end of each filterless contact is aligned for mating engagement with the second mating end of the corresponding filter contact; and means for removably securing said adaptor member to said connector member with the mating end of each filterless contact in mating engagement with the second mating ends of the corresponding filter contact, said means for removably securing is a coupling nut mounted on said adaptor ring, said means for orienting comprises key means coacting between said coupling nut and said connector shell, said keying means including a spring finger mounted externally on said coupling nut and a keyway in the external surface of said shell, said spring finger being radially deflectable from said keyway when the coupling nut is rotated to draw the mating contacts on the connector member and the adaptor member into mating engagement.

5. The invention as defined in claim 4 including locking means for releasably locking said coupling nut to the adaptor ring.

6. The invention as defined in claim 4 wherein said locking means comprises a recess in the external surface of said ring and a spring biased element on said coupling nut and adapted to be seated in said recess.

7. A repairable filter connector comprising:

a first connector member detachably interconnected with an adaptor member, said first connector member being adapted to connect with a second connector member;

said first connector member including:

a shell having an external keyway;

a dielectric insert mounted within said shell; and a plurality of filter contacts non-removably mounted in said insert, each of said filter contacts having first and second mating ends;

said adaptor member including:

a dielectric insert;

a plurality of filterless contacts removably disposed in said insert, each of said filterless contacts having a wire receiving end and having a mating end adapted to mate with the second mating end of a corresponding one of said filter contacts;

a rotatable coupling member disposed about the adaptor member for removably connecting the adaptor member to the first connector member with the filterless contacts mated with the corresponding filter contacts, said coupling member including a key mounted externally thereon;

said key coacting between the adaptor member and the first connector member for orienting said adaptor member relative to said first connector member, said key being radially deflectable from said keyway when the coupling member is rotated to draw the mating contacts on the first connector member and the adaptor member into mating engagement, whereby the first connector member may be removed and replaced in the event any one of the filter contacts is defective.

* * * * *